US008036576B2

(12) United States Patent
Katoh et al.

(10) Patent No.: US 8,036,576 B2
(45) Date of Patent: Oct. 11, 2011

(54) DEVELOPING DEVICE INCLUDING A STIRRING MECHANISM FOR A TWO-COMPONENT DEVELOPER AND IMAGE FORMING APPARATUS INCLUDING SAME

(75) Inventors: Natsumi Katoh, Atsugi (JP); Junichi Matsumoto, Yokohama (JP); Nobuo Iwata, Sagamihara (JP); Tomoya Ohmura, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 347 days.

(21) Appl. No.: 12/129,961

(22) Filed: May 30, 2008

(65) Prior Publication Data

US 2008/0298844 A1 Dec. 4, 2008

(30) Foreign Application Priority Data

Jun. 1, 2007 (JP) ..... 2007-146952

(51) Int. Cl.
*G03G 15/08* (2006.01)

(52) U.S. Cl. ..... 399/255; 399/256

(58) Field of Classification Search ..... 399/254, 399/255, 256, 263; 222/235, 236, DIG. 1
See application file for complete search history.

(56) References Cited

U.S. PATENT DOCUMENTS

| | | | | |
|---|---|---|---|---|
| 3,191,642 | A * | 6/1965 | Saito | 141/128 |
| 4,024,993 | A * | 5/1977 | Hanada | 222/272 |
| 4,171,165 | A * | 10/1979 | Card | 366/186 |
| 4,207,995 | A * | 6/1980 | Neely | 222/231 |
| 4,917,272 | A * | 4/1990 | Ikeda | 222/231 |
| 5,087,546 | A * | 2/1992 | Kanda et al. | 430/137.22 |
| 6,405,010 | B2 * | 6/2002 | Ashikari et al. | 399/262 |
| 6,882,803 | B2 * | 4/2005 | Ashida et al. | 399/27 |
| 6,882,816 | B2 | 4/2005 | Tamai | |
| 7,085,522 | B2 | 8/2006 | Muramatsu et al. | |
| 7,127,198 | B2 | 10/2006 | Muramatsu et al. | |
| 7,346,286 | B2 | 3/2008 | Matsumoto et al. | |
| 7,356,288 | B2 | 4/2008 | Iwata et al. | |
| 7,515,853 | B2 * | 4/2009 | Kimura et al. | 399/258 |
| 7,540,310 | B2 * | 6/2009 | Huss | 141/129 |
| 2005/0281592 | A1 | 12/2005 | Muramatsu et al. | |
| 2007/0009289 | A1 | 1/2007 | Muramatsu et al. | |
| 2007/0053721 | A1 | 3/2007 | Matsumoto et al. | |
| 2007/0053723 | A1 | 3/2007 | Iwata et al. | |

(Continued)

FOREIGN PATENT DOCUMENTS

EP 0 652 493 A2 5/1995

(Continued)

*Primary Examiner* — Robert Beatty
(74) *Attorney, Agent, or Firm* — Oblon, Spivak, McClelland, Maier & Neustadt, L.L.P.

(57) ABSTRACT

A developing device including a developing unit configured to develop an electrostatic latent image formed on a latent image bearing member with a developer comprising a toner and a carrier, and a circulation unit configured to collect the developer from the developing unit and return the developer to the developing unit. The circulation unit includes a container including a main body having an inverted cone shape, a supply opening provided in a top thereof, and a discharge opening provided in a bottom thereof, configured to hold a part of the developer and provided on an upstream side from the developing unit relative to a direction of circulation of the developer. The container includes a plurality of agitation members configured to agitate the developer collected from the developing unit and fresh toner so that a plurality of flows of the developer is produced in the container.

28 Claims, 10 Drawing Sheets

U.S. PATENT DOCUMENTS

| | | | |
|---|---|---|---|
| 2007/0079893 | A1 | 4/2007 | Huss |
| 2007/0154242 | A1 | 7/2007 | Matsumoto et al. |
| 2007/0264053 | A1 | 11/2007 | Iwata et al. |
| 2007/0274740 | A1 | 11/2007 | Katoh et al. |

FOREIGN PATENT DOCUMENTS

| | | | | |
|---|---|---|---|---|
| JP | 60250373 | A | * | 12/1985 |
| JP | 4-198966 | | | 7/1992 |
| JP | 7-295322 | | | 11/1995 |
| JP | 09185232 | A | * | 7/1997 |
| JP | 10-39617 | | | 2/1998 |
| JP | 11-143192 | | | 5/1999 |
| JP | 11-143196 | | | 5/1999 |
| JP | 2001-188408 | | | 7/2001 |
| JP | 2002006598 | A | * | 1/2002 |
| JP | 2002-251070 | | | 9/2002 |
| JP | 3349286 | | | 9/2002 |
| JP | 2003-292156 | | | 10/2003 |
| JP | 3596800 | | | 9/2004 |
| JP | 3734096 | | | 10/2005 |

* cited by examiner

DEVELOPING DEVICE INCLUDING A STIRRING MECHANISM FOR A TWO-COMPONENT DEVELOPER AND IMAGE FORMING APPARATUS INCLUDING SAME

CROSS-REFERENCE TO RELATED APPLICATIONS

The present patent application is based on and claims priority under 35 U.S.C. §119 from Japanese Patent Application No. 2007-146952, filed on Jun. 1, 2007 in the Japan Patent Office, the entire contents of which are incorporated herein by reference.

BACKGROUND OF THE INVENTION

1. Field of the Invention

Exemplary aspects of the present invention generally relate to a developing device employing a stirring mechanism for a two-component developer, and an image forming apparatus including the developing device.

2. Description of the Background

A related-art image forming apparatus, such as a copier, a facsimile machine, a printer, or a multifunction printer having two or more of copying, printing, scanning, and facsimile functions, forms a toner image on a recording medium (e.g., a sheet) according to image data using an electrophotographic method. In such a method, for example, a charger charges a surface of an image bearing member (e.g., a photoconductor); an optical scanning device emits a light beam onto the charged surface of the photoconductor to form an electrostatic latent image on the photoconductor according to the image data; the electrostatic latent image is developed with a developer (e.g., a toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

In such an image forming apparatus, either a one-component developer consisting essentially of a toner (e.g., magnetic toner and non-magnetic toner) or a two-component developer including a toner and a carrier which carries the toner is used for development.

The toner, when agitated and mixed into the carrier, is frictionally charged so as to be electrostatically attracted to the electrostatic latent image formed on the photoconductor. Thus, the toner is consumed during development whereas the carrier is not.

A typical developing device, which holds the developer, generally includes a developing sleeve, configured to form a magnetic brush of the developer on a surface thereof and to supply the developer to the electrostatic latent image formed on the photoconductor, and an agitator sleeve, configured to supply agitated developer to the developing sleeve. Developer in which the toner has been consumed in the development of the electrostatic latent image formed on the photoconductor is collected and returned to the developing device.

Consumption of the toner included in the developer causes a decrease in image density, and therefore fresh toner needs to be supplied to the developer. The fresh toner may be supplied from above a conveyance screw including a screw auger serving as the agitator sleeve, or from an edge of a rotation shaft of the conveyance screw.

The fresh toner is supplied to the developer based on developer density detected by a toner density sensor or the like, in amounts controlled by controlling a rotation of a supply member configured to supply the fresh toner stored in a toner supply unit. When the fresh toner is poured into the developer in a developer tank, the fresh toner and a carrier are agitated by the conveyance screw provided in the vicinity of the supply member so that the developer is frictionally charged. As a result, the developer having a predetermined or desired charge is supplied to the developing sleeve.

Published unexamined Japanese patent application No. (hereinafter referred to as JP-A) 2001-188408 discloses a developing device including a screw auger configured to agitate a developer to frictionally charge the developer as described above. JP-A 11-143196 discloses a developing device in which an agitating unit provided separately from a developing unit at a position where a developer is circulated agitates collected developer and supplied toner so that the resultant developer is frictionally charged. Japanese Patent No. (hereinafter referred to as JP) 3734096 discloses a developing device in which an agitating unit provided separately from a developing unit includes a screw auger configured to move a developer upward.

In general, the supplied toner is dispersed throughout the developer, and the developer is frictionally charged by being agitated by rotation of the screw auger for a short time until the developer thus prepared is conveyed to the developing sleeve. Consequently, the degree of mixing depends in part on the amounts supplied. Thus, when a larger amount of toner is supplied to the developer, the toner may not be dispersed sufficiently in the developer in the brief time allotted for agitation, and consequently, the toner may not be charged sufficiently when discharged from the developer tank. As a result, weakly charged toner could reach the developing sleeve, fouling of a surface of the photoconductor and scattering over peripheral components, thereby degrading image quality.

When the screw auger described above is used, only that developer which contacts the screw auger itself is agitated, as is the case when using a stirring paddle. Consequently, the supplied toner may not be sufficiently dispersed in the developer and reliably charged in the developer tank.

One possible method for solving the above-described problem is to increase a rotation speed of the screw auger to cause the toner to contact the carrier more frequently so that a predetermined or desired charge is reliably applied to the developer. However, the screw auger driving system may be damaged due to the increased transfer resistance to the developer when the developer is agitated. Moreover, the toner may be damaged due to increased force of impact on the developer and heat caused by increased friction, increasing stress on the developer.

SUMMARY

In view of the foregoing, exemplary embodiments of the present invention provide a developing device using a two-component developer, in which a mechanism capable of supplying a necessary amount of the developer having a predetermined or desired toner density and charge without causing deterioration of the developer is included, and an image forming apparatus employing the developing device.

In one exemplary embodiment, a developing device includes a developing unit configured to develop an electrostatic latent image formed on a latent image bearing member with a developer comprising a toner and a carrier, and a circulation unit configured to collect the developer from the developing unit and return the developer to the developing unit. The circulation unit includes a container including a main body having an inverted cone shape, a supply opening provided in a top thereof, and a discharge opening provided in a bottom thereof, configured to hold a part of the developer and provided on an upstream side from the developing unit relative to a direction of circulation of the developer. The container includes a plurality of agitation members configured to agitate the developer collected from the developing unit and fresh toner so that a plurality of flows of the developer is produced in the container.

Another exemplary embodiment provides an image forming apparatus including a latent image bearing member configured to bear an electrostatic latent image; a charging device configured to charge a surface of the latent image bearing member; an irradiating device configured to scan and irradiate a charged surface of the latent image bearing member with a light beam according to image data to form an electrostatic latent image thereon; a developing device configured to develop the electrostatic latent image with a toner to form a toner image, which includes the developing unit and the circulation unit as described above; a transfer device configured to transfer the toner image onto a recording medium; and a fixing device configured to fix the toner image on the recording medium.

Additional features and advantages of the present invention will be more fully apparent from the following detailed description of exemplary embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein.

DETAILED DESCRIPTION OF EXEMPLARY EMBODIMENTS

Figure 1:
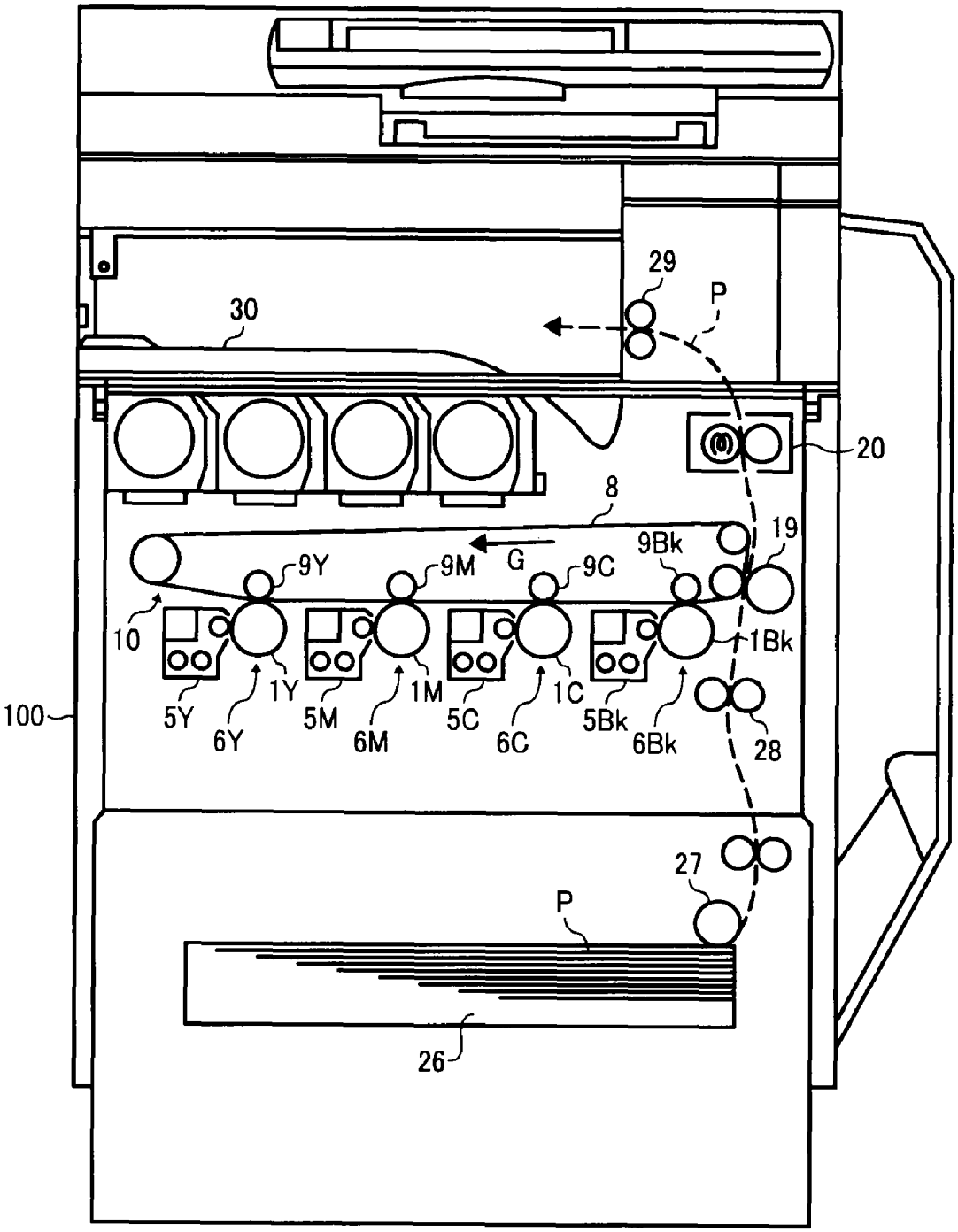
FIG. 1 is a schematic view illustrating an embodiment of an image forming apparatus employing a developing device according to exemplary embodiments.

It will be understood that if an element or layer is referred to as being "on," "against," "connected to" or "coupled to" another element or layer, then it can be directly on, against connected or coupled to the other element or layer, or intervening elements or layers may be present.

In contrast, if an element is referred to as being "directly on", "directly connected to" or "directly coupled to" another element or layer, then there are no intervening elements or layers present. Like numbers refer to like elements throughout.

As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures.

It will be understood that the spatially relative terms are intended to encompass different orientations of the device in use or operation in addition to the orientation depicted in the figures.

For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms.

These terms are used only to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Exemplary embodiments of the present invention are now described below with reference to the accompanying drawings.

In a later-described comparative example, exemplary embodiment, and exemplary variation, for the sake of simplicity the same reference numerals will be given to identical constituent elements such as parts and materials having the same functions and redundant descriptions thereof omitted unless otherwise stated.

Typically, but not necessarily, paper is the medium from which is made a sheet on which an image is to be formed. It should be noted, however, that other printable media are available in sheets, and accordingly their use here is included. Thus, solely for simplicity, although this Detailed Description section refers to paper, sheets thereof, paper feeder, etc., it should be understood that the sheets, etc., are not limited only to paper but includes other printable media as well.

To facilitate an understanding the present disclosure, specifically the structure and operation of a developing device and an image forming apparatus including the developing device, a description is first given of an embodiment of an image forming apparatus in which a developing device according to exemplary embodiments is incorporated.

FIG. 1 is a schematic view illustrating an embodiment of an image forming apparatus 100 employing a developing device according to exemplary embodiments.

In the image forming apparatus 100, image forming units 6Y, 6M, 6C, and 6Bk (hereinafter collectively referred to as image forming units 6), respectively corresponding to toner colors of yellow, magenta, cyan, and black, are arranged side by side facing a lower surface of an intermediate transfer belt 8 serving as an unfixed image bearing member of an intermediate transfer unit 10. Each of the image forming units 6 has the same configuration, the only difference being the color of the toner used for image formation.

The image forming units 6Y, 6M, 6C, and 6Bk, respectively, include photoconductive drums 1Y, 1M, 1C, and 1Bk (hereinafter collectively referred to as photoconductive drums 1), each serving as a latent image bearing member; chargers, not shown, respectively provided around the photoconductive drums 1; developing devices 5Y, 5M, 5C, and 5Bk (hereinafter collectively referred to as developing devices 5); cleaning devices, not shown; and so forth.

Image formation, including charging, irradiating, developing, transferring, and cleaning, is performed on each of the photoconductive drums 1. As a result, respective toner images are formed on the photoconductive drums 1.

The photoconductive drums 1 are rotatively driven in a clockwise direction in FIG. 1 by a driving unit, not shown. Surfaces of the photoconductive drums 1 are evenly charged by the chargers.

When the surfaces of the photoconductive drums 1 thus charged respectively reach irradiation positions of laser beams emitted from irradiating units, not shown, the laser beams are respectively scanned across the surfaces of the photoconductive drums 1 so that electrostatic latent images are respectively formed on the surfaces of the photoconductive drums 1. When the electrostatic latent images thus formed on the surfaces of the photoconductive drums 1 respectively reach the developing units 5, the electrostatic latent images are formed into visible images by toners included in developers supplied from the developing units 5.

When the surfaces of the photoconductive drums 1 having toner images thus formed into visible images thereon respectively reach positions facing primary transfer bias rollers 9Y, 9M, 9C, and 9Bk with the intermediate transfer belt 8 therebetween, the toner images are sequentially transferred onto the intermediate transfer belt 8.

After transfer of the toner images onto the intermediate transfer belt 8, the surfaces of the photoconductive drums 1 respectively reach the cleaning devices. Toner particles remaining on the surfaces of the photoconductive drums 1 are removed by the cleaning devices. Thereafter, charges on the surfaces of the photoconductive drums 1 are respectively neutralized by neutralizing rollers, not shown, thus completing one complete set of image forming operations performed on the photoconductive drums 1.

As illustrated in FIG. 1, the image formation described above is performed in each of the image forming units 6. Specifically, based on image data, laser beams are respectively emitted from the irradiating units provided below the image forming units 6 and directed onto the surfaces of the photoconductive drums 1. Thereafter, the respective color toner images formed on the surfaces of the photoconductive drums 1 through development are primarily transferred onto the intermediate transfer belt 8 in a primary transfer process so that the toner images are superimposed on one another on the intermediate transfer belt 8. Accordingly, a color toner image is formed on the intermediate transfer belt 8.

The primary transfer process is described in detail below.

The primary transfer bias rollers 9Y, 9M, 9C, and 9Bk (hereinafter collectively referred to as primary transfer bias rollers 9) respectively form primary transfer nips with the photoconductive drums 1Y, 1M, 1C, and 1Bk with the intermediate transfer belt 8 therebetween. A transfer bias having a polarity opposite to that of the toner is applied to each of the primary transfer bias rollers 9.

The intermediate transfer belt 8 is rotated in a direction indicated by an arrow G in FIG. 1, and sequentially passes through the primary transfer nips respectively formed by the primary transfer bias rollers 9. As a result, the toner images respectively formed on the photoconductive drums 1 are primarily transferred onto the intermediate transfer belt 8, and the color toner image is formed on the intermediate transfer belt 8.

When the color toner image formed on the intermediate transfer belt 8 reaches a secondary transfer roller 19 serving as a secondary transfer means, the color toner image is transferred onto a transfer sheet P serving as a recording medium conveyed to a secondary transfer nip.

A paper feeder 26 provided on the bottom of the image forming apparatus 100 stores a plurality of transfer sheets P. The transfer sheets P are fed sheet by sheet by a paper feed roller 27. The transfer sheet P thus fed is temporality stopped by a pair of registration rollers 28. After the transfer sheet P has been properly aligned, the transfer sheet P is conveyed to the secondary transfer nip at a predetermined or desired timing by the pair of registration rollers 28. Accordingly, the color toner image is transferred onto the transfer sheet P at the secondary transfer nip as described above.

The transfer sheet P having the color toner image thereon is conveyed to a fixing device 20. In the fixing device 20, heat and pressure are applied to the transfer sheet P from a fixing roller and a pressure roller to fix the color toner image onto the transfer sheet P.

The transfer sheet P having a fixed image thereon is discharged by a pair of discharge rollers 29 and stacked on a discharge tray 30 provided on an upper surface of the image forming apparatus 100. Thus, one complete set of image forming operations is performed in the image forming apparatus 100.

A description is now given of the developing device of the present invention.

Figure 2:
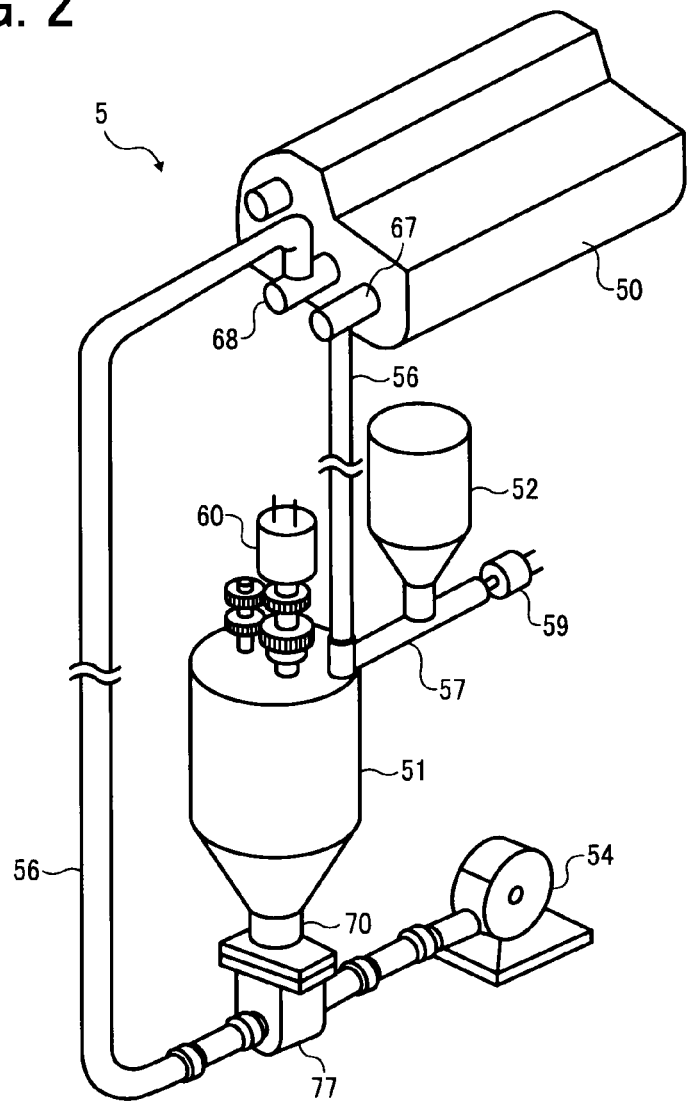
FIG. 2 is a perspective view illustrating an example of a configuration of the developing device.

FIG. 2 is a perspective view illustrating an example of a configuration of the developing device 5 according to exemplary embodiments.

Referring to FIG. 2, the developing device 5 includes a developing unit 50 configured to develop electrostatic latent images on the photoconductive drums 1 with a two-component developer comprising a carrier and a toner, and a circulation unit configured to convey a developer collected from the developing unit 50 to a developer supply unit of the developing unit 50.

More specifically, the developing device 5 includes the developing unit 50; a developer container 51 configured to agitate the developer collected from the developing unit 50 and fresh toner of the same amount as that of toner consumed in the developing unit 50, provided separately from the developing unit 50; a toner cartridge 52 configured to supply fresh toner to the developer container 51; an air pump 54 serving as a developer circulation driving source for conveying the developer to the developing unit 50 with pressure; and so forth. In FIG. 1, the developing unit 50 is a cartridge type.

The developing unit 50 and the developer container 51 are connected by a circulation path 56 included in the circulation unit. The circulation path 56 includes an onward portion configured to convey the developer collected from the developing unit 50 to the developer container 51; and a return portion configured to convey the developer discharged from the developer container 51 to the developing unit 50, connected to one of conveyance screws each serving as the developer supply unit of the developing unit 50. In FIG. 2, reference numeral 59 denotes a motor serving as a toner supply driving source, and reference numeral 60 denotes a motor serving as an agitation driving source.

Figure 3:
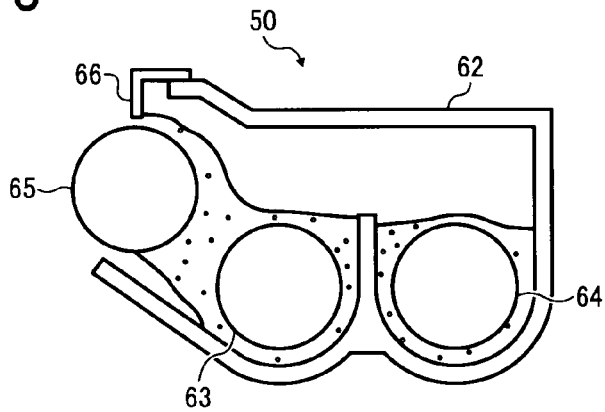
FIG. 3 is a schematic view illustrating an internal configuration of a developing unit in the developing device illustrated in FIG. 2.

FIG. 3 is a schematic view illustrating an internal configuration of the developing unit 50. Referring to FIG. 3, the developing unit 50 includes a casing 62; conveyance screws 63 and 64 each having a spiral fin, rotatively supported in the casing 62; and a developing roller 65.

The casing 62 is filled with the two-component developer comprising a toner and a carrier. The two-component developer is circulated and conveyed in the casing 62 by the conveyance screws 63 and 64.

The developer is conveyed by the conveyance screw 63 from a front side to a back side relative to the plane of paper on which FIG. 3 is illustrated, and a part of the developer thus conveyed is attracted to the developing roller 65 by magnetic force. Thereafter, a doctor blade 66 equalizes a thickness of the developer on the developing roller 65. When the developing roller 65 contacts the photoconductive drum 1, the electrostatic latent image formed on the photoconductive drum 1 is developed with the toner. Accordingly, a toner image is formed on the photoconductive drum 1.

After development, the developer is conveyed from a discharge opening 67 shown in FIG. 2, provided on an edge of the conveyance screw 64, to the developer container 51 through the onward portion of the circulation path 56.

A toner density detector, not shown, is provided on an extreme downstream portion of the conveyance screw 64. Fresh toner is supplied from the toner cartridge 52 in response to a signal from the toner density detector.

Referring back to FIG. 2, the fresh toner is supplied from the toner cartridge 52 to the developer container 51 by rotating a screw, not shown, provided in a toner supply path 57 by a motor 59. The fresh toner is supplied to the developer while being conveyed to the developer container 51 at a portion immediately above an entry to the developer container 51.

In the developer container 51, the developer collected from the developing unit 50 after development and the fresh toner supplied from the toner cartridge 52 are agitated and mixed together so that the developer thus prepared maintains a predetermined or desired toner density and charge to be described in detail later with reference to FIG. 4 and subsequent figures.

The developer discharged from the developer container 51 is conveyed to the return portion of the circulation path 56 through a shared pathway 77 by the air pump 54. After passing through the return portion of the circulation path 56, the developer is introduced into a reception opening 68 of the developing unit 50.

Figure 4:
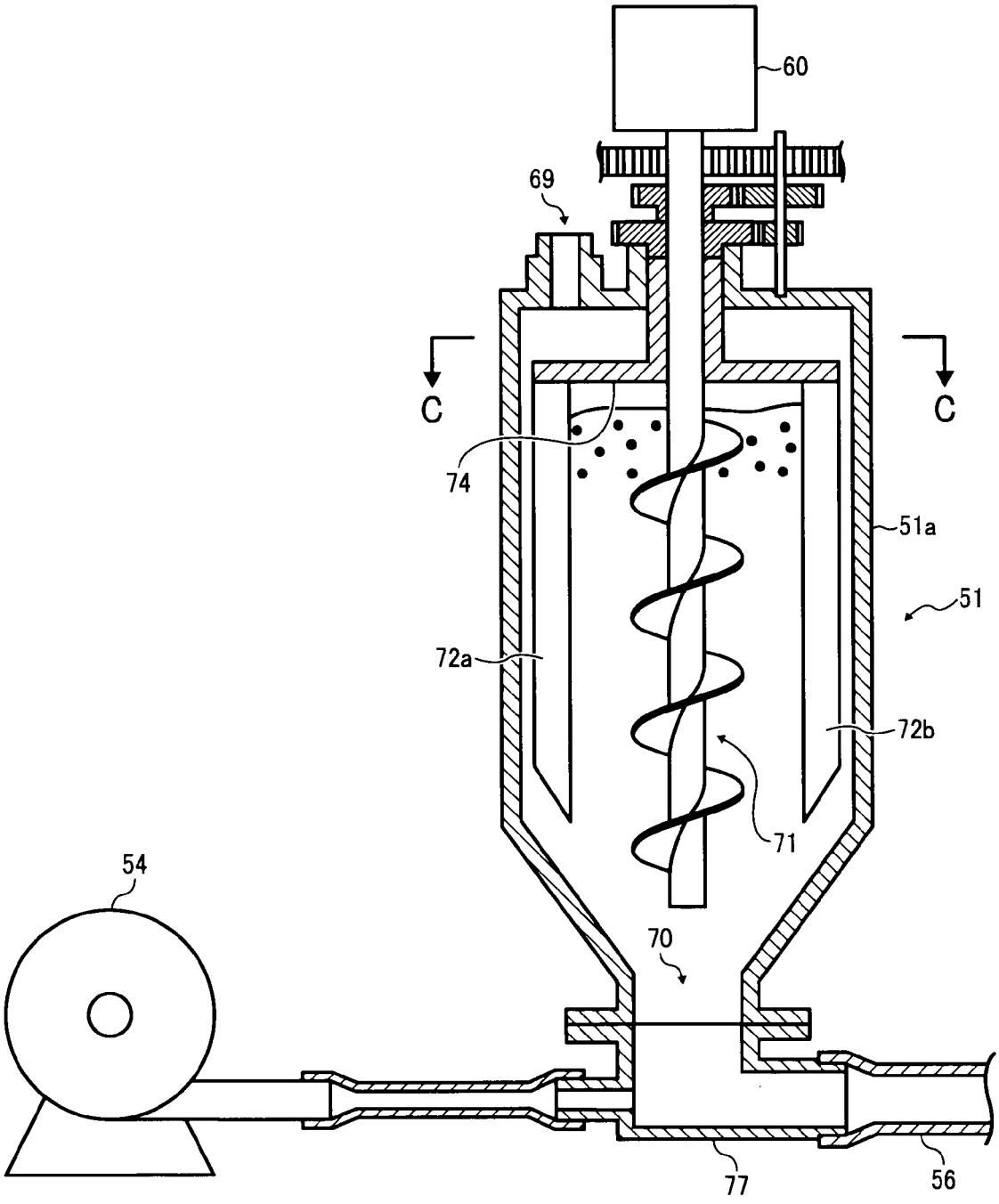
FIG. 4 is a vertical cross-sectional view illustrating the developing device illustrated in FIG. 2.

A description is now given of an agitation part provided in the developer container 51 with reference to FIG. 4 and subsequent figures.

Referring to FIG. 4, the developer container 51 includes a developer container main body 51*a* having an inverted cone funnel shape, of which diameter is gradually reduced toward a discharge opening 70. The developer container 51 further includes a developer supply opening 69 at the top thereof, and the discharge opening 70 at the bottom thereof.

In the developer container main body 51*a*, an agitation part including a first agitation member 71 and second agitation members 72*a* and 72*b* is provided. The first and second agitation members 71, 72*a*, and 72*b* are provided around a rotation shaft of the agitation part, which includes a center of a cross-section in the horizontal direction of the developer container main body 51*a*, and the first agitation member 71 is disposed interior to the second agitation members 72*a* and 72*b* in the center of the developer container main body 51*a*.

The first agitation member 71 includes a screw auger rotated in a direction such that the developer is moved upward. The second agitation members 72*a* and 72*b* are disposed exterior to the first agitation member 71 in the developer container main body 51*a*, and include stirring paddles capable of rotating around the rotation shaft of the first agitation member 71.

The second agitation members 72*a* and 72*b* are provided on opposite sides relative to a center of the rotation shaft of the first agitation member 71, and respectively have a longitudinal direction in a vertical direction of the developer container 51. A base edge of each of the second agitation members 72*a* and 72*b* is fixed to a flange 74 integrally provided on the rotation shaft of the first agitation member 71. Accordingly, the first agitation member 71 moves the developer in a direction opposite to a direction of falling of the developer while the second agitation members 72*a* and 72*b* are rotated in a direction perpendicular to the direction of falling of the developer to prevent the developer from moving downward.

Figure 5:
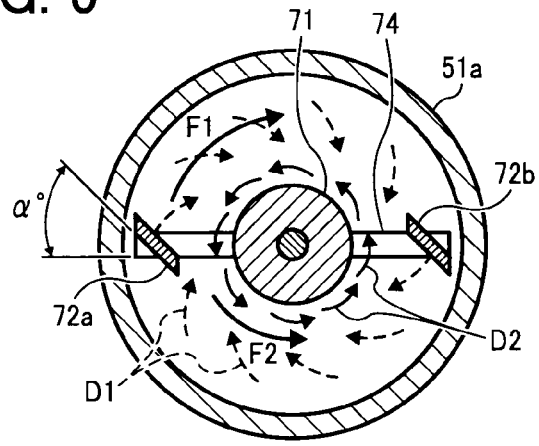
FIG. 5 is a cross-sectional view illustrating a developer container of the developing device along a line C-C in FIG. 4.

FIG. 5 is a cross-sectional view illustrating the developer container 51 along a line C-C in FIG. 4. In FIG. 5, the second agitation members 72*a* and 72*b* are respectively provided in the vicinity of edges of the flange 74 at an angle $\alpha°$ such that the developer is moved from an inner wall side of the developer container main body 51*a* toward the rotation shaft of the first agitation member 71 as indicated by an arrow D1 when the second agitation members 72*a* and 72*b* are rotated in a clockwise direction as indicated by an arrow F1 in FIG. 5.

The second agitation members 72*a* and 72*b* are respectively provided as close as possible to the inner wall of the developer container main body 51*a* without causing problems of the rotation thereof so as to maximize agitation area within a cross-section of the developer container 51.

The first agitation member 71 and the second agitation members 72*a* and 72*b* are configured to be rotated in directions different from each other. Accordingly, the developer is moved in different directions in the developer container main body 51*a* by the rotation of the first agitation member 71 and the second agitation members 72*a* and 72*b*. In other words, the first agitation member 71 is configured to be rotated in a direction indicated by an arrow F2 in FIG. 5 such that the developer is prevented from moving downward, and moved upward. Meanwhile, the second agitation members 72*a* and 72*b* are configured to be rotated in a direction indicated by the arrow F1 in FIG. 5, which is opposite to the rotation direction of the first agitation member 71.

When the first agitation member 71 is rotated in a counterclockwise direction as indicated by the arrow F2 in FIG. 5, the developer is moved in a direction indicated by an arrow D2 in FIG. 5. In addition, with the rotation of the first agitation member 71, the developer is moved upward as indicated by an arrow A in FIG. 6, which is a direction opposite to the direction of falling of the developer. Meanwhile, when the second agitation members 72*a* and 72*b* are rotated in a clockwise direction as indicated by the arrow F1 in FIG. 5, which is a direction perpendicular to the direction of falling of the developer to prevent the developer from moving downward, the developer is moved in the direction indicated by the arrow D1 in FIG. 5, which is different from the direction of movement of the developer indicated by the arrow D2 caused by the rotation of the first agitation member 71. Thus, the developer is agitated to move in several different directions in the developer container 51.

As illustrated in FIG. 5, the first agitation member 71 and the second agitation members 72*a* and 72*b* respectively move the developer in directions different from each other in the horizontal cross-section of the developer container 51 by rotation thereof. A more detailed description of this movement of the developer in different directions can be given with reference to FIG. 6.

Figure 6:
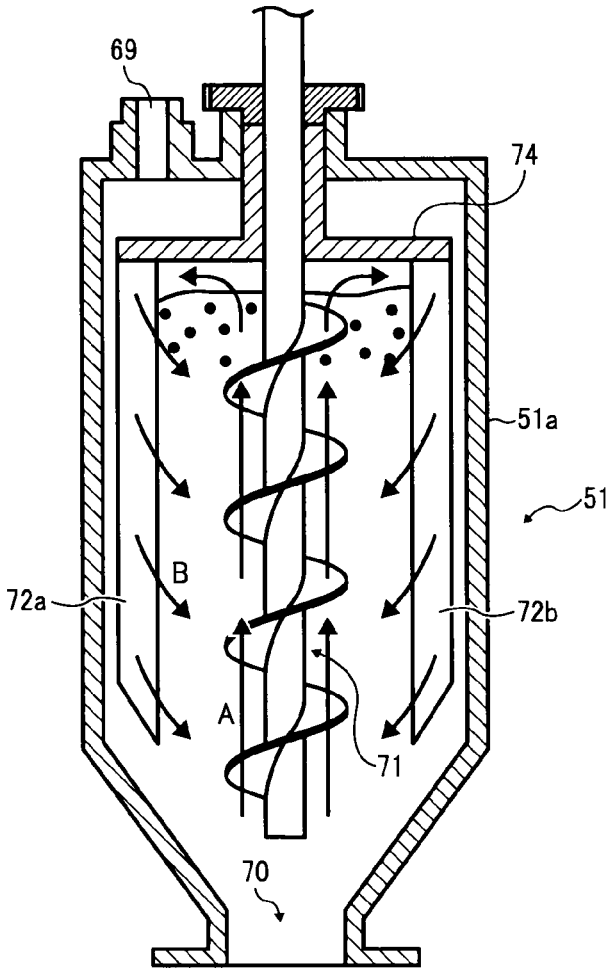
FIG. 6 is a vertical cross-sectional view illustrating the developer container illustrated in FIG. 4 to explain movement of a developer therein.

FIG. 6 is a vertical cross-sectional view illustrating the developer container 51 in FIG. 4. As described above, the developer moving downward by gravity is moved upward by the rotation of the first agitation member 71 as indicated by the arrow A in FIG. 6. Furthermore, the developer out of the agitation area of the first agitation member 71 and that moved upward to the top of the toner container 51 is collected from a peripheral portion of the developer container 51 and moved to the center thereof by the rotation of the second agitation members 72*a* and 72*b* as indicated by an arrow B in FIG. 6. Accordingly, the developer reaches the first agitation member 71 to be agitated by the first agitation member 71 again. Therefore, as illustrated in FIG. 6, the developer is convectively circulated in the developer container 51 so that the developer is agitated efficiently by using both the first agitation member 71 and the second agitation members 72*a* and 72*b*. As a result, the carrier and toner included in the developer contact each other more easily and the developer is more reliably applied to the developer.

According to the foregoing exemplary embodiment, the developer is agitated to move in several different directions and convectively circulated in the developer container 51 by the rotations of the first agitation member 71 and the second agitation members 72*a* and 72*b*. As a result, the developer is efficiently mixed in the developer container 51, decreasing damage to and stress on the developer.

More precisely, the developer is not likely to be efficiently mixed in the developer container 51 using only the first agitation member 71 because the developer is not convectively circulated reliably in the developer container 51 only by the rotation of the first agitation member 71. Although one possible technique to efficiently agitate the developer in the developer container 51 is to increase a rotation speed of the first agitation member 71, doing so also increases a moving speed of the developer. When being moved upward at an increased speed, the developer collides against the inner wall of the developer container main body 51*a* with a greater force, increasing damage to the developer.

The configuration of the present exemplary embodiment, in which the first agitation member 71 and the second agitation members 72*a* and 72*b* are provided in the developer container 51, enables the developer to be reliably agitated to move in several different directions and convectively circulated within the developer container 51. As a result, the developer is mixed efficiently and sufficiently in the developer container 51 without increasing the rotation speed of each of the first agitation member 71 and the second agitation members 72*a* and 72*b*, thereby decreasing damage and stress to the developer.

Furthermore, the developer is agitated to move in several different directions and convectively circulated also in a horizontal cross-sectional direction. Accordingly, the developer is charged efficiently because the carrier and the toner included in the developer contact each other more frequently.

In the forgoing exemplary embodiment, an amount of the developer discharged from the developer container 51 is almost identical to an amount of the developer introduced into the developer container 51. Accordingly, the developer is discharged from the developer container 51 without excess or deficiency even when the agitation part is provided to prevent the developer from moving downward. The developer container 51 functions as a buffer to store a predetermined or desired amount of the developer therein until the developer is discharged therefrom, preventing discharge of unmixed developer.

A description is now given of a configuration of the developing device 5 to control a discharge amount of the developer.

Figure 7:
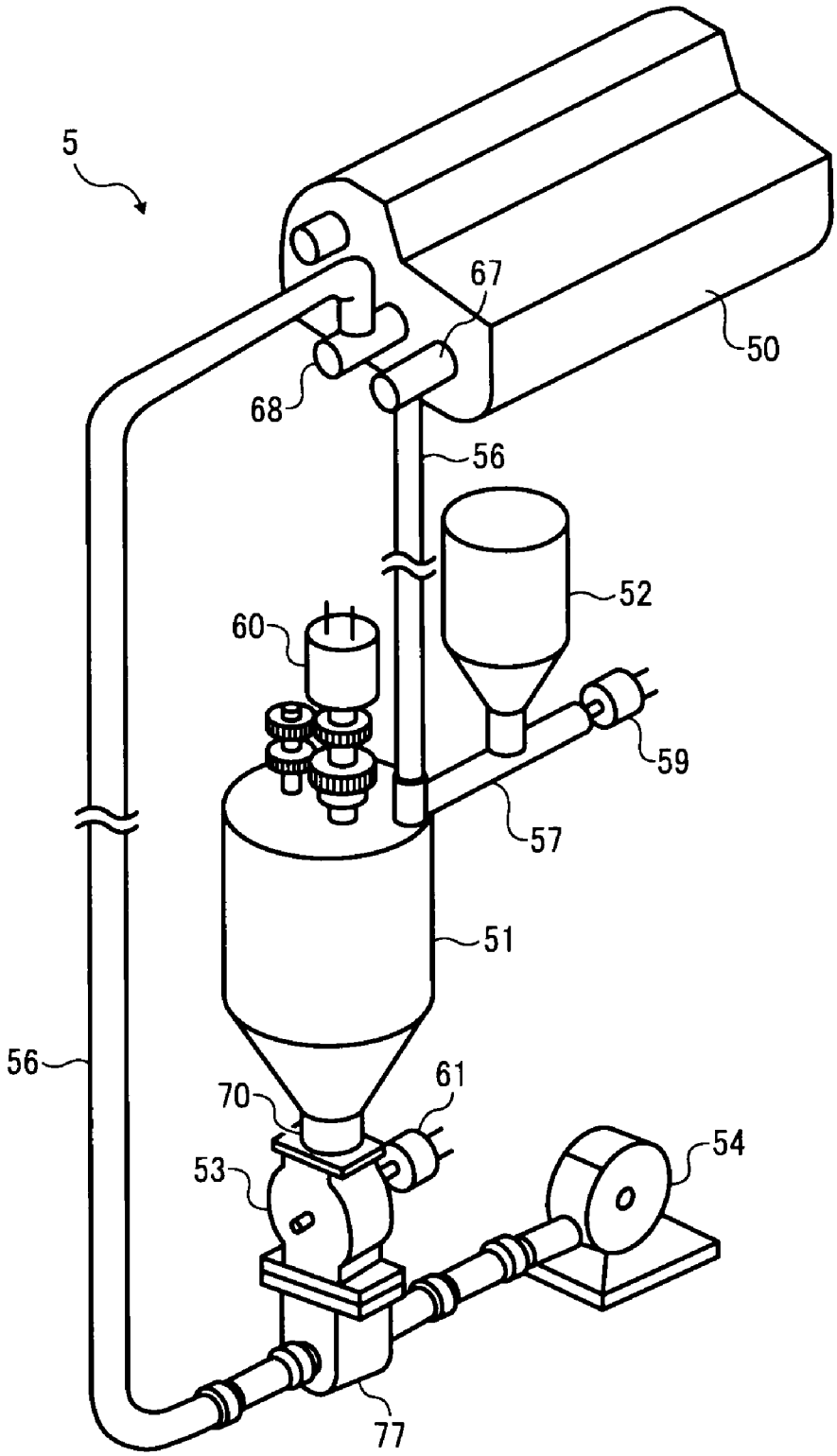
FIG. 7 is a perspective view illustrating another example of a configuration of the developing device.

FIG. 7 is a perspective view illustrating a means for controlling the discharge amount of the developer employed in the developing device 5 illustrated in FIG. 2.

Referring to FIG. 7, the developing device 5 includes a rotary feeder 53 serving as the means for controlling the discharge amount of the developer at the discharge opening 70 of the developer container 51, provided in front of the shared pathway 77. The rotary feeder 53 serves as a rotary valve, a rotation speed of which is controlled by a motor 61 that rotates the rotary feeder 53.

Figure 8:
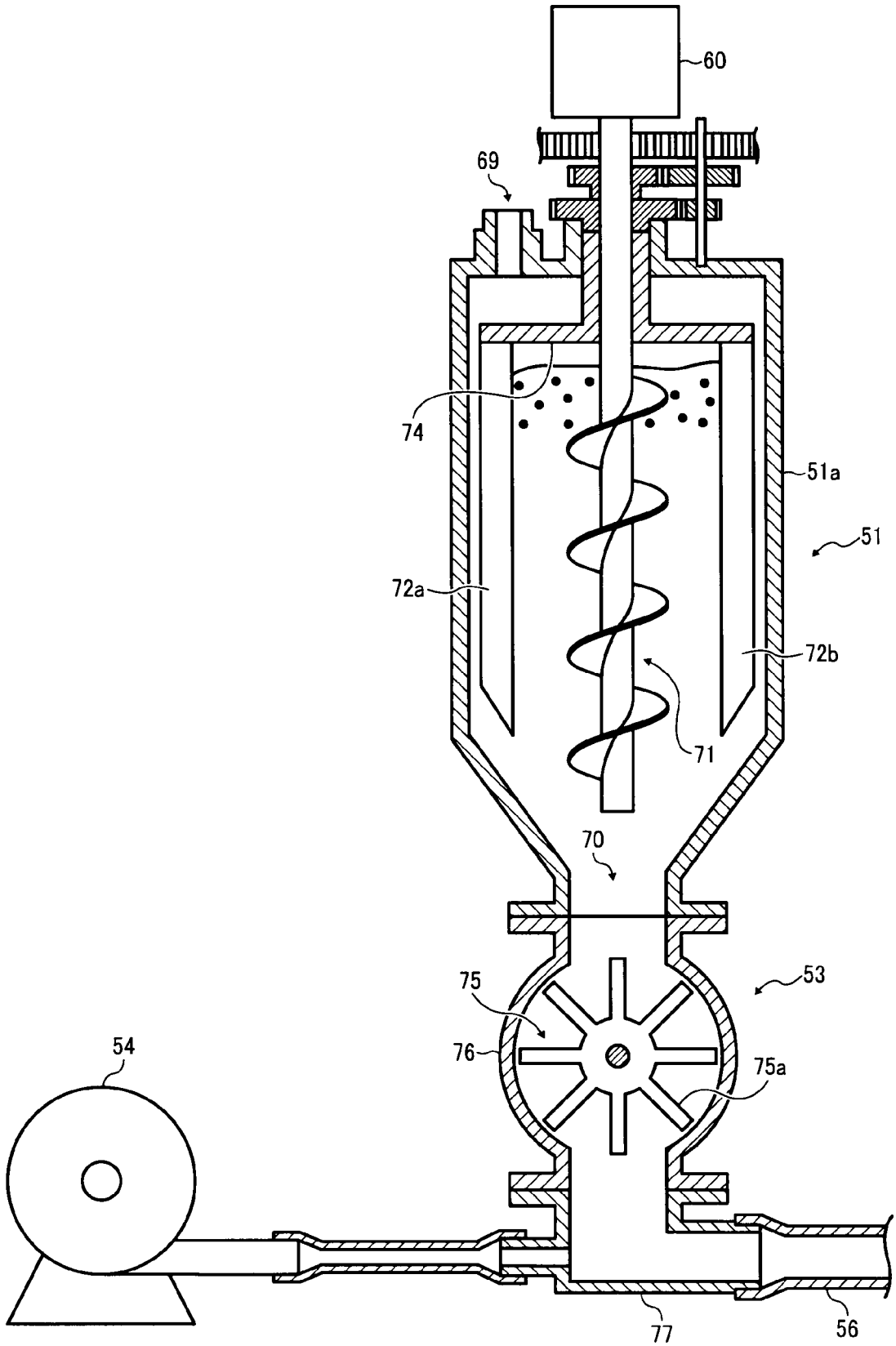
FIG. 8 is a vertical cross-sectional view illustrating the developing device illustrated in FIG. 7.

FIG. 8 is a vertical cross-sectional view illustrating the developing device 5 in FIG. 7. As illustrated in FIG. 8, the rotary feeder 53 includes a rotor 75 having a plurality of blades 75*a* extending radially from a central shaft and a stator 76 covering the rotor 75.

In the present exemplary embodiment, the rotation speed of the rotary feeder 53 is controlled so as to control the discharge amount of the developer. In other words, the discharge amount of the developer is set based on the rotation speed of the rotary feeder 53. Control of the discharge amount of the developer is important in order to obtain uniformly mixed developer.

Specifically, the toner density and the charge of the developer collected to the developer container 51 tend to be uneven. Moreover, the amount of the fresh toner supplied to the developer in the developer container 51 may change depending on the amount of the toner consumed for development. Consequently, agitation time required to apply a sufficient charge to the developer to be discharged to the developing unit 50 may also change. More specifically, it is not necessary to agitate the developer when no fresh toner is supplied from the toner cartridge 52. On the other hand, a longer time is required to sufficiently agitate the developer when a larger amount of fresh toner is supplied from the toner cartridge 52. Furthermore, because the charge of the developer may change depending on temperature and humidity, the same agitation time cannot be set for the same developer amount under different environmental conditions.

To solve the above-described problems, agitation of the developer needs to be controlled based on a state of the developer introduced into the developer container 51. In the present invention, a rotation speed of the agitation part is increased when it is difficult to sufficiently charge the developer due to a larger amount of supply of the fresh toner from the toner cartridge 52 or higher humidity. On the other hand, the rotation of the agitation part is stopped when no fresh toner is supplied.

However, if the rotation of the agitation part is controlled as described above, an amount of the developer moving down to the discharge opening 70 may decrease when the rotation speed of the agitation part is increased because the agitation members 72*a* and 72*b* are rotated in a direction for preventing the developer from moving downward.

As described above, the developer container 51 functions as a buffer for keeping a predetermined or desired amount of the developer agitated by the agitation part therein. Therefore, a difference between an amount of the developer discharged from the developer container 51 and an amount of the developer moving down to the discharge opening 70, if any, can be absorbed. However, the amount of the developer kept in the developer container 51 tends to be gradually reduced depending how the rotation of the agitation part is controlled.

To prevent such gradual reduction, according to the present invention a constant amount of the developer is returned to the developing unit 50 regardless of the control state of the rotation of the agitation part, thus preventing a change in the amount of the developer conveyed to the developing unit 50.

However, when the rotary feeder 53 illustrated in FIGS. 7 and 8 is used, the motor 54 serving as a driving source may include a stepper motor, a step count of which is controlled so as to adjust the rotation speed of the rotary feeder 53 to control the amount of the developer conveyed to the developing unit 50.

Figure 9:
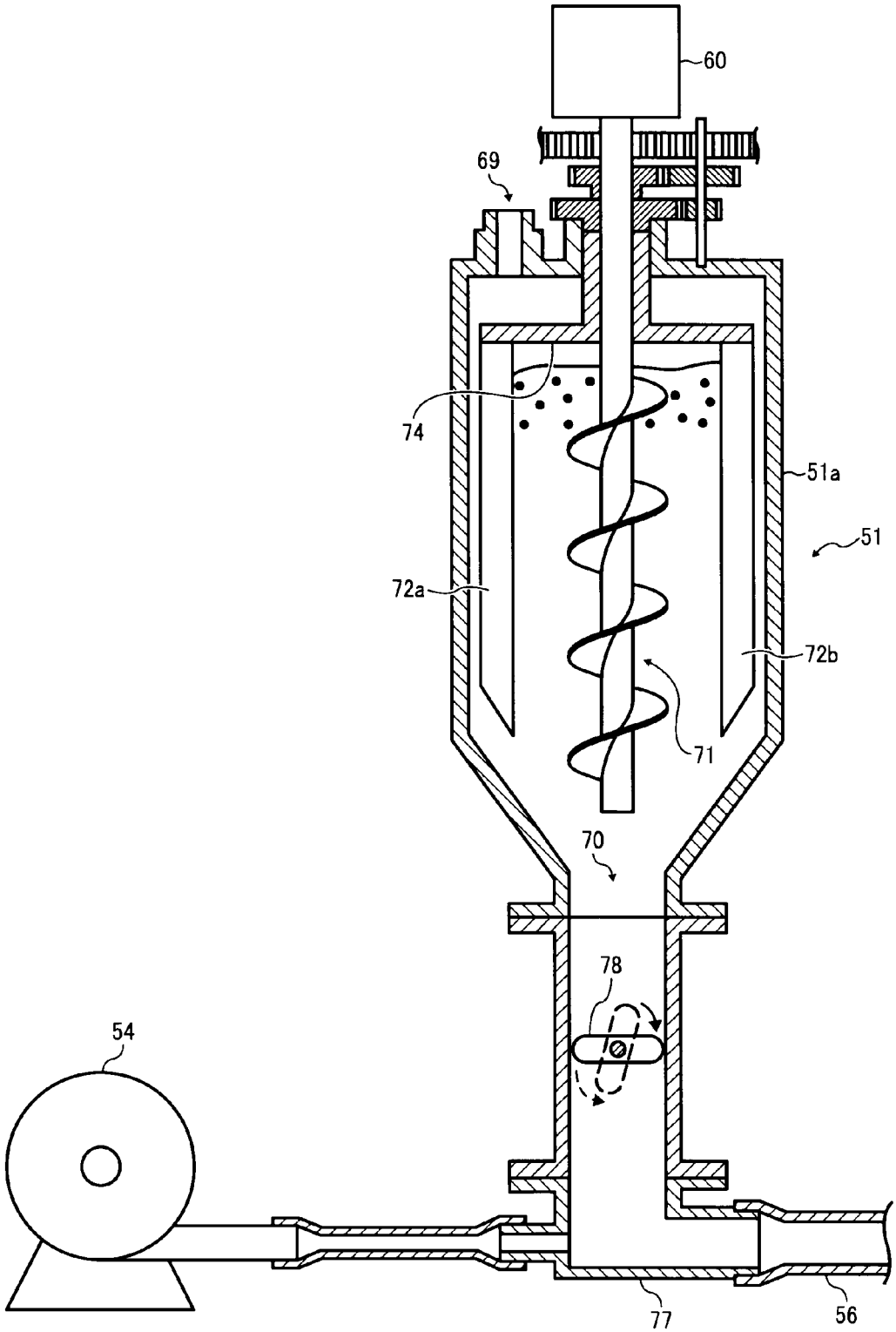
FIG. 9 is a vertical cross-sectional view illustrating yet another example of a configuration of the developing device.

FIG. 9 is a vertical cross-sectional view illustrating another example of the means for controlling the discharge amount of the developer employed in the developing device 5 illustrated in FIG. 2. Referring to FIG. 9, a butterfly valve 78, of which an opening angle to a flow path is changed by an angle of rotation thereof, is used as the means for controlling the discharge amount of the developer. Similarly to the configuration illustrated in FIG. 7, the opening angle of the butterfly valve 78 is controlled by controlling the rotation speed of the motor 54.

With the above-described configurations, the amount of the developer discharged from the developer container 51 can be controlled regardless of the control state of the rotation of the agitation part. Accordingly, a constant amount of the developer can be reliably conveyed to the developing unit 50, preventing any insufficiency of developer in the developing unit 50 from arising.

Figure 10A:
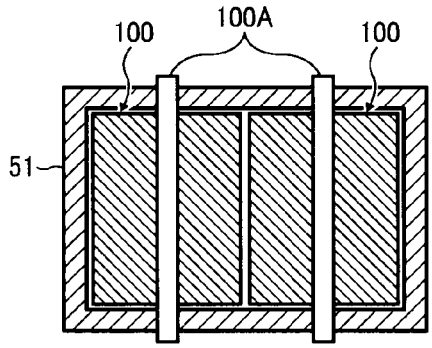
FIG. 10A is a cross-sectional view illustrating a variation of an agitation part in the developer container along a line E-E in FIG. 10B.
Figure 10B:
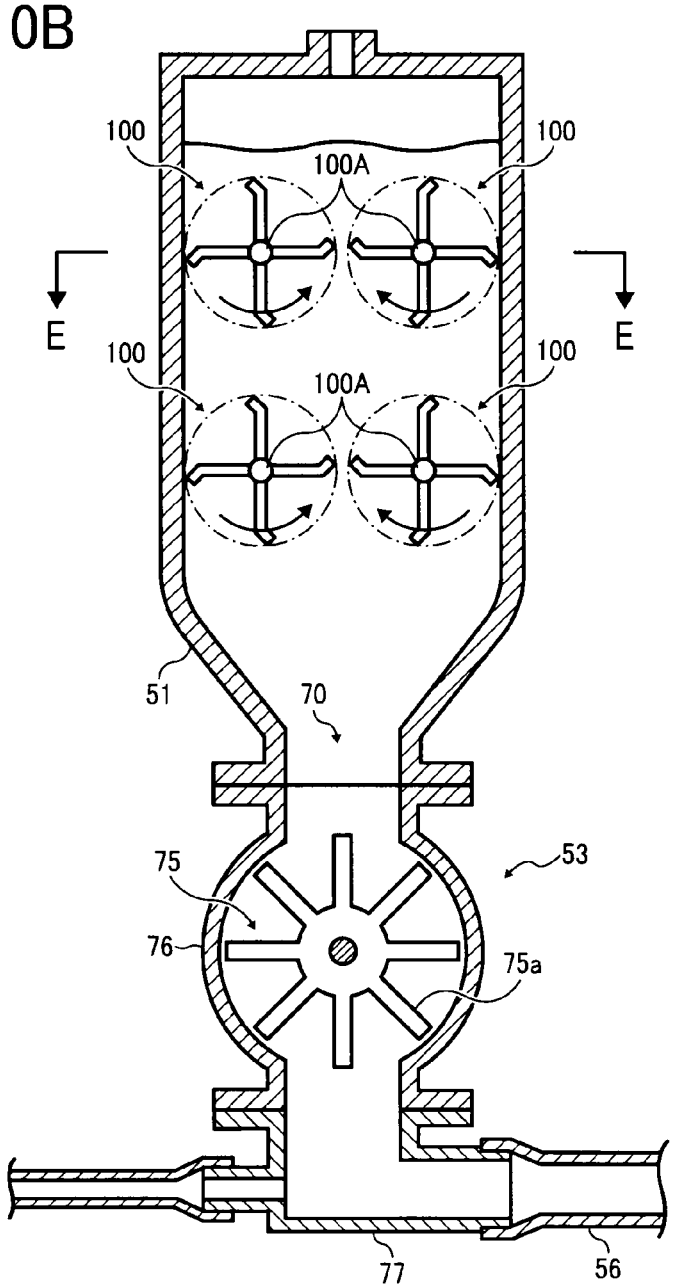
FIG. 10B is a vertical cross-sectional view illustrating the variation of the agitation part in the developer container.
Figure 10C:
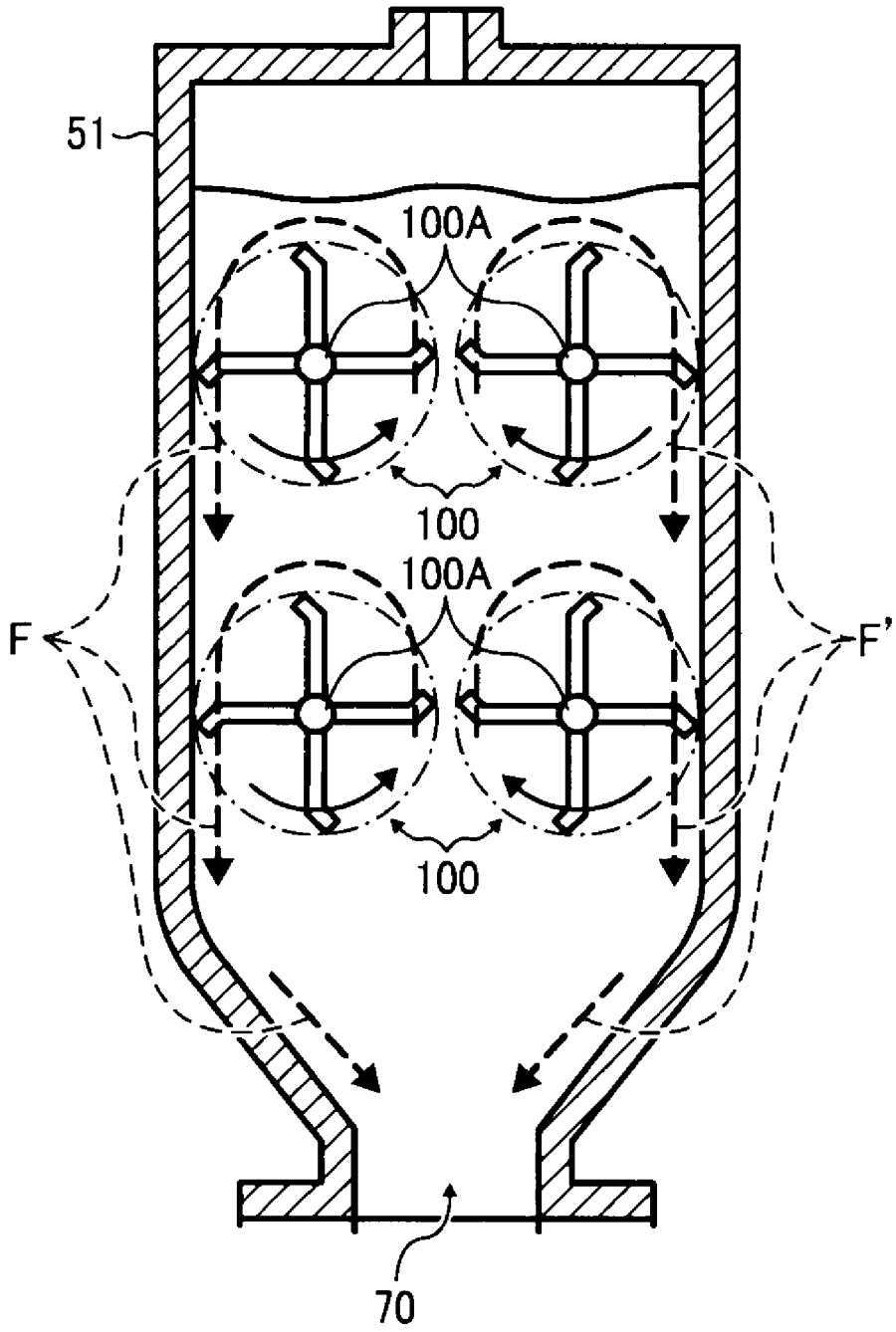
FIG. 10C is a vertical cross-sectional view illustrating the developer container illustrated in FIG. 10B to explain movement of a developer therein.

A variation of the agitation part provided in the developer container 51 is illustrated in FIGS. 10A to 10C. In contrast to the configuration illustrated in FIG. 8, the developer container 51 according to the variation example includes a plurality of stirring paddles each serving as an agitation member in horizontal and vertical directions. Each of the stirring paddles has a rotation shaft extending in a horizontal direction, which is perpendicular to the direction of falling of the developer. FIG. 10A is a cross-sectional view illustrating the developer container 51 of the variation example along a line E-E in FIG. 10B.

Referring to FIG. 10A, a stirring paddle 100 includes a rotation shaft 100A extending in a horizontal direction, which is perpendicular to the direction of falling of the developer. The rotation shaft 100A is provided on a plurality of positions in the developer container 51 in a horizontal direction and along the direction of falling of the developer.

As illustrated in FIG. 10A, the rotation shaft 100A is extended in the horizontal direction so that the stirring paddle 100 can be arranged within a storage space for the developer when a horizontal cross-section of the developer container 51 is rectangular. As a result, even portions in the vicinity of corners of the horizontal cross-section of the developer container 51 can be set as the agitation area.

As illustrated in FIG. 10B, the developer container 51 of the variation example includes the plurality of stirring paddles 100 along the direction of falling of the developer, as well as in the horizontal direction of the cross-section of the developer container 51. The plurality of stirring paddles 100 provided in the horizontal direction is rotated in directions opposite to each other as indicated by arrows in FIG. 10B. Similarly to the foregoing exemplary embodiment, the plurality of stirring paddles 100 is respectively rotated in the directions for preventing the developer from moving downward. As a result, the developer is agitated in directions so as not to fall down and to be convectively circulated in the developer container 51. In other words, as illustrated in FIG. 10C, the developer is prevented from moving downward but instead moved upward in a center of the horizontal cross-section of the developer container 51 where the plurality of stirring paddles 100 is provided close to each other. After being moved out of the center of the cross-section of the developer container 51, the developer is then moved downward along the rotation directions of the plurality of stirring paddles 100 to the discharge opening 70 provided on the bottom of the developer container 51. In FIG. 10C, the directions of movement of the developer are indicated by arrows F and F'.

As described above, the developer container 51 according to the variation example includes the plurality of stirring paddles 100 in the horizontal direction thereof and along the direction of falling of the developer. Because the plurality of stirring paddles 100 is rotated in directions different from each other, the developer can be convectively circulated reliably in the developer container 51. Therefore, in contrast to the configuration in which the developer is moved only in the direction of falling thereof, the developer is sufficiently dispersed and mixed in the developer container 51 with the configuration described above. As a result, the toner and the carrier contact each other more frequently, increasing chargeability of the toner and preventing a decrease in density of the developer.

The rotation shafts 100A of the plurality of stirring paddles 100 provided along the direction of falling of the developer are not limited to being provided parallel to each other, and may be placed perpendicular to each other.

Figure 11A:
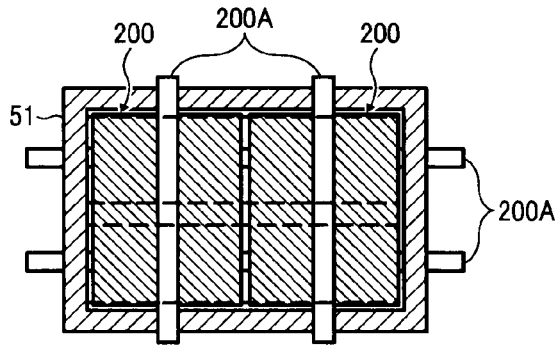
FIG. 11A is a cross-sectional view illustrating an another variation of the agitation part in the developer container along a line H-H in FIG. 11B.
Figure 11B:
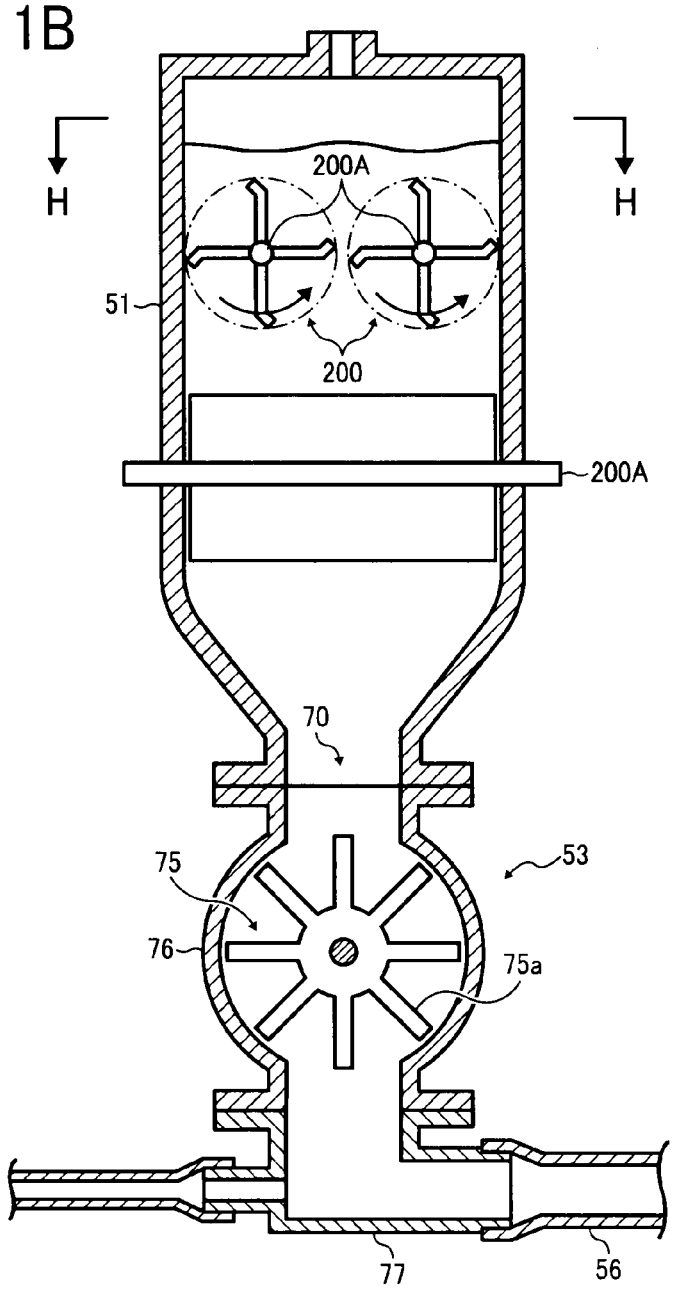
FIG. 11B is a vertical-cross-sectional view illustrating the another variation of the agitation part in the developer container.

Such a configuration is illustrated in FIGS. 11A and 11B. FIG. 11A is a cross-sectional view of the developer container 51 along a H-H in FIG. 11B. In FIG. 11B, rotation shafts 200A of stirring paddles 200 provided in the direction of falling of the developer are provided perpendicular to each other in a horizontal direction.

Such a configuration enables the developer to be convectively circulated more reliably in the developer container 51 so that the toner and the carrier are agitated sufficiently, improving chargeability of the developer.

Elements and/or features of different exemplary embodiments may be combined with each other and/or substituted for each other within the scope of this disclosure and appended claims.

Example embodiments being thus described, it will be obvious that the same may be varied in many ways. Such exemplary variations are not to be regarded as a departure from the spirit and scope of the present invention, and all such modifications as would be obvious to one skilled in the art are intended to be included within the scope of the following claims.

The number of constituent elements, locations, shapes and so forth of the constituent elements are not limited to any of the structure for performing the methodology illustrated in the drawings.

What is claimed is:

1. A developing device, comprising:

a developing unit configured to develop an electrostatic latent image formed on a latent image bearing member with a developer comprising a toner and a carrier; and a circulation unit configured to collect the developer from the developing unit and return the developer to the developing unit, the circulation unit comprising a container including a main body having a supply opening provided in an upper portion thereof and a discharge opening provided in a lower portion thereof, the container configured to hold a part of the developer, the container comprising a plurality of agitation members configured to agitate the developer collected from the developing unit and fresh toner so that a plurality of flows of the developer is produced in the container, the plurality of agitation members each comprising stirring paddles which rotate around rotation shafts extending in a horizontal direction perpendicular to a falling direction of the developer, wherein the plurality of agitation members is provided in vertical and horizontal directions in the main body of the container, and directions of rotation of the plurality of agitation members are independently controllable.

2. The developing device according to claim 1, wherein one of the plurality of agitation members of the container agitates the developer introduced from the supply opening in a direction that prevents the developer from moving downward by gravity.

3. The developing device according to claim 1, wherein each of the plurality of flows of the developer has a different flow direction.

4. The developing device according to claim 1, wherein each of the plurality of agitation members agitates the developer in a direction that produces a convection of the developer in the container.

5. The developing device according to claim 1, wherein an amount of the developer discharged from the container is substantially identical to an amount of the developer introduced into the container.

6. The developing device according to claim 5, wherein the container further comprises a control unit provided on the discharge opening of the container and configured to control the amount of the developer discharged from the container.

7. The developing device according to claim 6, wherein the control unit comprises a rotary valve that controls the amount of the developer discharged from the container by varying a rotation speed thereof.

8. The developing device according to claim 1, wherein the agitation members are rotated in opposite directions.

9. The developing device according to claim 2, wherein the agitation members are rotated in opposite directions.

10. The developing device according to claim 1, wherein a timing of rotations of the plurality of agitation members are controllable.

11. An image forming apparatus comprising the developing device according to claim 1.

12. The developing device according to claim 10, wherein a length of rotations of the plurality of agitation members are controllable.

13. A developing device, comprising:

a developing unit configured to develop an electrostatic latent image formed on a latent image bearing member with a developer comprising a toner and a carrier; and a circulation unit configured to collect the developer from the developing unit and return the developer to the developing unit, the circulation unit comprising a container including a main body having a supply opening provided in an upper portion thereof and a discharge opening provided in a lower portion thereof, the container configured to hold a part of the developer, the container comprising a plurality of agitation members configured to agitate the developer collected from the developing unit and fresh toner so that a plurality of flows of the developer is produced in the container, wherein a timing of rotations of the plurality of agitation members are controllable.

14. The developing device according to claim 13, wherein one of the plurality of agitation members of the container agitates the developer introduced from the supply opening in a direction that prevents the developer from moving downward by gravity.

15. The developing device according to claim 13, wherein each of the plurality of flows of the developer has a different flow direction.

16. The developing device according to claim 13, wherein each of the plurality of agitation members agitates the developer in a direction that produces a convection of the developer in the container.

17. The developing device according to claim 13, wherein each of the plurality of agitation members comprises:

a first agitation member comprising a screw auger which rotates around a rotation shaft extending in a vertical direction; and a second agitation member comprising a stirring paddle rotatable around the rotation shaft, provided exterior to the first agitation member.

18. The developing device according to claim 13, wherein each of the plurality of agitation members comprises stirring paddles which rotate around rotation shafts extending in a horizontal direction perpendicular to a falling direction of the developer.

19. The developing device according to claim 18, wherein the plurality of agitation members is provided in vertical and horizontal directions in the main body of the container, and directions of rotation of the plurality of agitation members are independently controllable.

20. The developing device according to claim 13, wherein an amount of the developer discharged from the container is substantially identical to an amount of the developer introduced into the container.

21. The developing device according to claim 20, wherein the container further comprises a control unit provided on the discharge opening of the container and configured to control the amount of the developer discharged from the container.

22. The developing device according to claim 21, wherein the control unit comprises a rotary valve that controls the amount of the developer discharged from the container by varying a rotation speed thereof.

23. The developing device according to claim 13, wherein the agitation members are rotated in opposite directions.

24. The developing device according to claim 19, wherein the agitation members are rotated in opposite directions.

25. An image forming apparatus comprising the developing device according to claim 13.

26. The developing device according to claim 13, wherein a length of rotations of the plurality of agitation members are controllable.

27. The developing device according to claim 17, wherein the rotation shaft includes a center of a cross-section in a horizontal direction of the container.

28. The developing device according to claim 17, wherein the screw auger is rotated to move the developer upward.

* * * * *